US011022134B2

(12) United States Patent
Doo et al.

(10) Patent No.: US 11,022,134 B2
(45) Date of Patent: Jun. 1, 2021

(54) OIL PUMP OF VEHICLE HAVING INNER RING

(71) Applicants: Hyundai Motor Company, Seoul (KR); KIA Motors Corporation, Seoul (KR); MYUNG HWA IND. Co., Ltd., Seoul (KR)

(72) Inventors: Jae-Kyun Doo, Seoul (KR); Kyung-Hwan Oh, Seoul (KR); Hyun-Eu Jung, Hwaseong-si (KR)

(73) Assignees: HYUNDAI MOTOR COMPANY, Seoul (KR); KIA MOTORS CORPORATION, Seoul (KR); MYUNG HWA IND. CO., LTD., Seoul (KR)

( * ) Notice: Subject to any disclaimer, the term of this patent is extended or adjusted under 35 U.S.C. 154(b) by 41 days.

(21) Appl. No.: 16/355,043

(22) Filed: Mar. 15, 2019

(65) Prior Publication Data

US 2019/0353178 A1 Nov. 21, 2019

(30) Foreign Application Priority Data

May 18, 2018 (KR) ..... 10-2018-0057186

(51) Int. Cl.
*F04D 29/22* (2006.01)
*F04D 29/24* (2006.01)
*F01M 1/02* (2006.01)

(52) U.S. Cl.
CPC ..... *F04D 29/2294* (2013.01); *F01M 1/02* (2013.01); *F04D 29/2227* (2013.01);
(Continued)

(58) Field of Classification Search
CPC .. F01M 2001/0238; F16N 13/20; F16N 13/22
See application file for complete search history.

(56) References Cited

U.S. PATENT DOCUMENTS 3,758,859 A * 9/1973 Damijonaitis ..... G01P 3/488 324/174
3,887,035 A * 6/1975 Hannibal ..... F04B 39/16 184/6.16

(Continued)

FOREIGN PATENT DOCUMENTS

GB 416255 A * 9/1934 ..... B64C 11/36
JP 60085284 A * 5/1985 ..... F04C 15/0088

(Continued)

OTHER PUBLICATIONS

Phenolic Novolac And Resol Resins—Phenolic thermosetting resin Feb. 2014 (Year: 2014).*
KR20120060098A Machine Translation (Year: 2012).*

*Primary Examiner* — Ninh H. Nguyen
*Assistant Examiner* — Brian Christopher Delrue
(74) *Attorney, Agent, or Firm* — Brinks Gilson & Lione

(57) ABSTRACT

The present disclosure provides an oil pump including a housing in which a space is formed, a rotor installed to be rotatable in an eccentric position in the housing and having vanes mounted along a circumference direction to be protruded and retracted in a radial direction of the housing, and an inner ring fitted to an inner surface of the housing and rotated along with the rotor when the rotor rotates. The housing is formed of a material harder than the material of the inner ring, and oil for lubrication is provided between the housing and the inner ring.

11 Claims, 5 Drawing Sheets

(52) U.S. Cl.
CPC ..... *F04D 29/2238* (2013.01); *F04D 29/2266* (2013.01); *F04D 29/247* (2013.01); *F01M 2001/0238* (2013.01)

(56) References Cited

U.S. PATENT DOCUMENTS 3,926,281 A * 12/1975 Hannibal ..... F04B 39/0261 184/6.16
4,291,651 A * 9/1981 Villella ..... F01M 1/02 123/41.32
4,513,215 A * 4/1985 Del Serra ..... H02K 5/167 29/598
4,583,926 A * 4/1986 Mitsumori ..... F01C 21/0836 418/137
4,998,867 A * 3/1991 Sakamaki ..... F01C 21/0809 418/256
5,228,334 A * 7/1993 Stone ..... G01L 19/0609 73/114.43
RE34,473 E * 12/1993 Ryan ..... A47J 27/21008 99/285
5,273,819 A * 12/1993 Jex ..... B29C 70/14 428/299.1
5,501,585 A * 3/1996 Ogawa ..... F04C 2/102 418/171
6,183,230 B1 * 2/2001 Beardmore ..... F04C 15/0073 403/359.6
6,276,910 B1 * 8/2001 Tsukamoto ..... F04C 29/028 418/100
8,398,381 B1 * 3/2013 Schumann ..... F04B 17/05 417/304
9,057,266 B2 * 6/2015 Viitamaki ..... F01C 1/348
9,115,716 B2 * 8/2015 Sekiya ..... F01C 21/0836
9,127,675 B2 * 9/2015 Sekiya ..... F04C 18/321
9,382,907 B2 * 7/2016 Sekiya ..... F01C 21/0836
9,388,807 B2 * 7/2016 Sekiya ..... F01C 21/0863
9,399,993 B2 * 7/2016 Sekiya ..... F04C 18/321
9,458,849 B2 * 10/2016 Sekiya ..... F01C 21/0836
9,683,567 B2 * 6/2017 Chikaoka ..... F04C 2/10
2003/0072656 A1 * 4/2003 Niwatsukino ..... F04D 5/002 417/354
2004/0161355 A1 * 8/2004 Dees ..... F16N 13/20 418/171
2008/0000309 A1 * 1/2008 Tsubouchi ..... F01M 1/02 74/68
2008/0141921 A1 * 6/2008 Hinderks ..... B64D 27/04 114/274
2009/0068049 A1 * 3/2009 Saito ..... F04C 2/3446 418/77
2009/0142221 A1 * 6/2009 Strangman ..... B22F 3/1208 420/441
2012/0051955 A1 * 3/2012 Hadar ..... F04C 2/3442 417/410.3
2013/0053210 A1 * 2/2013 Kari ..... F16C 41/008 475/331
2015/0285301 A1 * 10/2015 Begin ..... F01D 25/18 123/568.11
2017/0126087 A1 * 5/2017 Soderberg ..... H02K 1/17
2017/0159713 A1 * 6/2017 Ito ..... H01L 35/30
2017/0184099 A1 * 6/2017 Watanabe ..... F01C 21/108
2017/0204753 A1 * 7/2017 Sacomori ..... F04B 39/0261
2018/0058450 A1 * 3/2018 McGowan ..... F04C 2/084
2018/0223835 A1 * 8/2018 Maki ..... C23C 4/131
2018/0274388 A1 * 9/2018 Oh ..... F01D 25/162
2020/0003209 A1 * 1/2020 Eto ..... F04C 15/06
2020/0080555 A1 * 3/2020 Bennett, Sr. ..... F04C 2/3442
2020/0080561 A1 * 3/2020 Hong ..... F04C 25/02
2020/0153368 A1 * 5/2020 Kobayashi ..... H02K 5/225

FOREIGN PATENT DOCUMENTS

KR 2012/0060098 A 6/2012
KR 20120060098 A * 6/2012
WO WO-2019240436 A1 * 12/2019 ..... F04C 2/10

* cited by examiner

OIL PUMP OF VEHICLE HAVING INNER RING

CROSS-REFERENCE TO RELATED APPLICATION

This application claims priority to and the benefit of Korean Patent Application No. 10-2018-0057186, filed on May 18, 2018, which is incorporated herein by reference in its entirety.

FIELD

The present disclosure relates to an oil pump for pressurizing engine oil of a vehicle.

BACKGROUND

The statements in this section merely provide background information related to the present disclosure and may not constitute prior art.

An engine mounted on a vehicle circulates engine oil for reducing the friction of each moving part and for cooling. The engine oil is pressurized by an oil pump mounted inside the engine and supplied to the lubrication parts.

As a prior art, an oil pump structure is shown in FIG. 1. The oil pump 110 includes a housing 111 in which a space is formed, a rotor 112 which is eccentrically rotated inside the housing 111, and vanes 113 which are slidable in the radial direction of the rotor 112 and installed at intervals along the circumferential direction of the rotor 112. Since the vanes 113 are installed so that the front ends of the vanes 113 are in close contact with the inner surface of the housing 111, the oil is compressed by the volume change of the space between the inner surface of the housing 111 and the vanes 113 adjacent to the outer surface of the rotor 112 and each other when the rotor 112 rotates.

However, in the oil pump 110 according to the prior art as described above, since the vanes 113 are rotated by the rotor 112 and simultaneously performs a sliding motion with respect to the rotor 112, it is found that the moving parts of the oil pump 110 are abruptly abraded when the rotation speed of the oil pump 110 is increased.

The inner surface of the housing 111 is nitriding-treated, the vane 113 is made of tool steel, and the outer surface of the rotor 112 is also steam-treated.

In recent years, the engine has been upgraded to high performance, so that the oil pump 110 is often operated under severe conditions, thereby promoting abrasion.

The foregoing is intended merely to aid in the understanding of the background of the present disclosure, and is not intended to mean that the present disclosure falls within the purview of the related art that is already known to those skilled. The above information disclosed in this Background section is only for enhancement of understanding of the background of the present disclosure, and therefore it may contain information that does not form the prior art that is already known to a person of ordinary skill in the art.

SUMMARY

The present disclosure provides an oil pump having an inner ring in which the material of a housing is replaced by a lightweight material, and the rotatable inner ring is provided at an inner surface of the housing to be contacted with vanes.

An oil pump according to a form of the present disclosure may include a housing in which a space is formed, a rotor installed to be rotatable in an eccentric position on the housing and having vanes mounted along a circumferential direction to be protruded and retracted in a radial direction of the housing, and an inner ring fitted to an inner surface of the housing and rotated along the rotor when the rotor rotates. The housing is formed of a material harder than the inner ring, and oil for lubrication is provided between the housing and the inner ring.

The housing may be made of synthetic resin material. In particular, the housing may be made of thermosetting phenolic resin material.

According to other form of the present disclosure, the housing may be made of a light metal having a specific gravity lower than that of steel. In particular, the housing may be made of aluminum or magnesium.

The inner ring may be made of metal material. In particular, the inner ring may be made of the same material as the vane. Accordingly, the inner ring may be made of bearing steel or tool steel.

According to further aspect of the present disclosure, at least one of an outer circumference surface of the inner ring and an inner surface of the housing may be formed with at least one groove for accommodating oil between the inner ring and the housing.

The groove may be formed on the inner surface of the housing as a first groove along the circumference of the housing.

The groove may be formed on the outer circumference surface of the inner ring as a second groove along the circumference of the inner ring.

The housing may be provided with at least one oil supply hole for supplying oil between the inner surface of the housing and the inner ring.

The outer surface of the housing may be provided with at least one pocket formed concavely from the outside of the housing to the inner surface of the housing. The pockets may be formed along the circumference direction and the height direction of the housing.

In accordance with the form of the present disclosure, the oil pump includes the housing made of synthetic resin material so that it can be lightweight. Furthermore, the inner surface of the housing is contacted to the inner ring having excellent abrasion resistance, thereby improving abrasion resistance.

In addition, since the housing is made of synthetic resin material, it is possible to form the housing shapes as desired to reduce Noise, Vibration and Harshness (NVH). For example, pockets on the outer surface of the housing can be easily formed.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
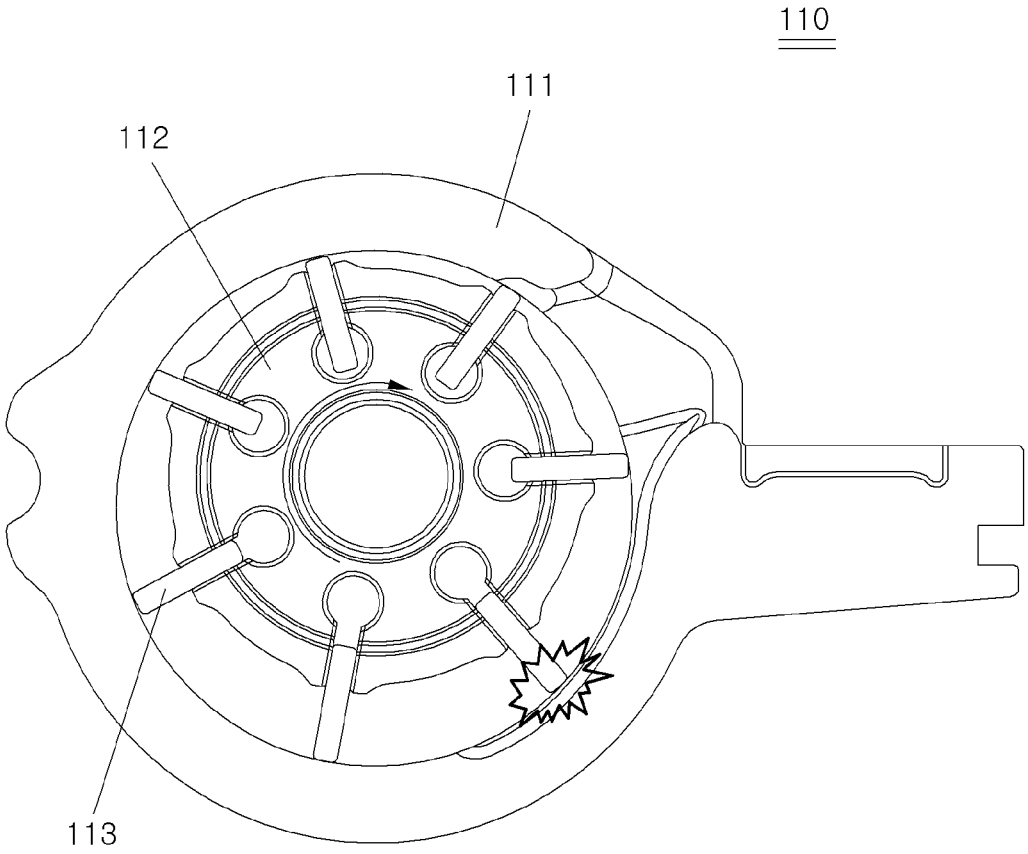
FIG.1 (Prior Art)
FIG. 1 is a plane view of an oil pump according to a prior art.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Figure 2:
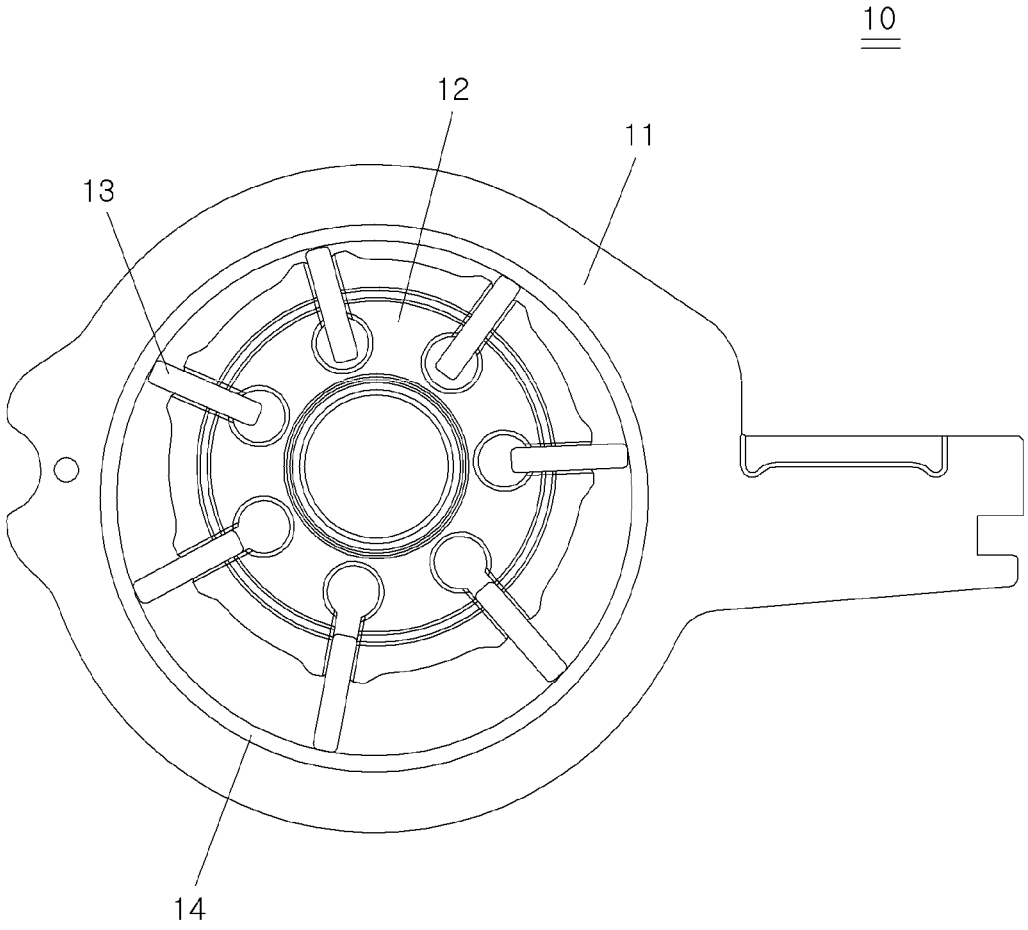
FIG. 2 is a plan view showing an oil pump with an inner ring according to an exemplary form of the present disclosure.

Referring to FIG. 2, an oil pump 10 having an inner ring 14 according to the present disclosure may include a housing 11 in which a space is formed, a rotor 12 being installed to be rotatable in an eccentric position on the housing 11 and having vanes 13 mounted along a circumference direction to be protruded and retracted in a radial direction of the housing 11, and the inner ring 14 which is fitted to an inner surface of the housing 11 and rotates along the rotor 12 when the rotor 12 rotates. The housing 11 may be formed of a material harder than the inner ring 14, and oil for lubrication may be accommodated between the housing 11 and the inner ring 14.

The space may be formed in the housing 11. Constituent elements described below may be provided in the space of the housing 11.

The rotor 12 may be installed to be rotatable in an eccentrically located position on the housing 11 and have the vane 13 mounted along a circumference direction to be protruded and retracted in a radial direction of the housing 11.

The inner ring 14 may be fitted to the inner surface of the housing 11. The inner ring 14 may rotate along the rotor 12 when the rotor 12 rotates. The inner ring 14 may be contact with the rotating vane 13 and formed into a cylinder shape to be fitted to the inner surface of the housing 11.

As shown in FIG. 2, when the rotor 12 rotates, the inner ring 14 may rotate in the same direction as the vane 13. Since the inner ring 14 rotates along the vane 13 when the vane 13 rotates, the inner ring 14 rotates at a later rotation speed than the rotor 12.

The inner ring 14 and the housing 11 may be the duality structure, so that the fixed housing 11 may be formed of lightweight material and the inner ring 14 directly contacting with the rotating vane 13 may be formed of a material having a higher strength than the housing 11. More specifically, the housing 11 may be formed of synthetic resin or light metal material, and the housing 11 may be made of thermosetting phenolic resin material in synthetic resin and also, a light metal having a specific gravity lower than that of steel, for example, aluminum or magnesium.

The inner ring 14 may be made of material that is stronger than the housing 11, for example steel. Preferably, the inner ring 14 may made of bearing steel or tool steel that is the same material as the vane 13 because the vane 13 may also be made of bearing steel or tool steel. The bearing steel and tool steel have excellent abrasion resistance, which can reduce the abrasion between the vane 13 and the inner ring 14 contacted with each other.

Accordingly, since the housing 11 is made of a lightweight material and the inner ring 14 contacting the vane 13 is made of a high-strength material, the weight of the oil pump 10 can be reduced and fuel consumption can be improved.

When the rotor 12 rotates with the inner ring 14 together, lubrication is desired between the housing 11 and the inner ring 14. For this purpose, an oil film is formed to contain oil between the housing 11 and the inner ring 14.

Figure 3:
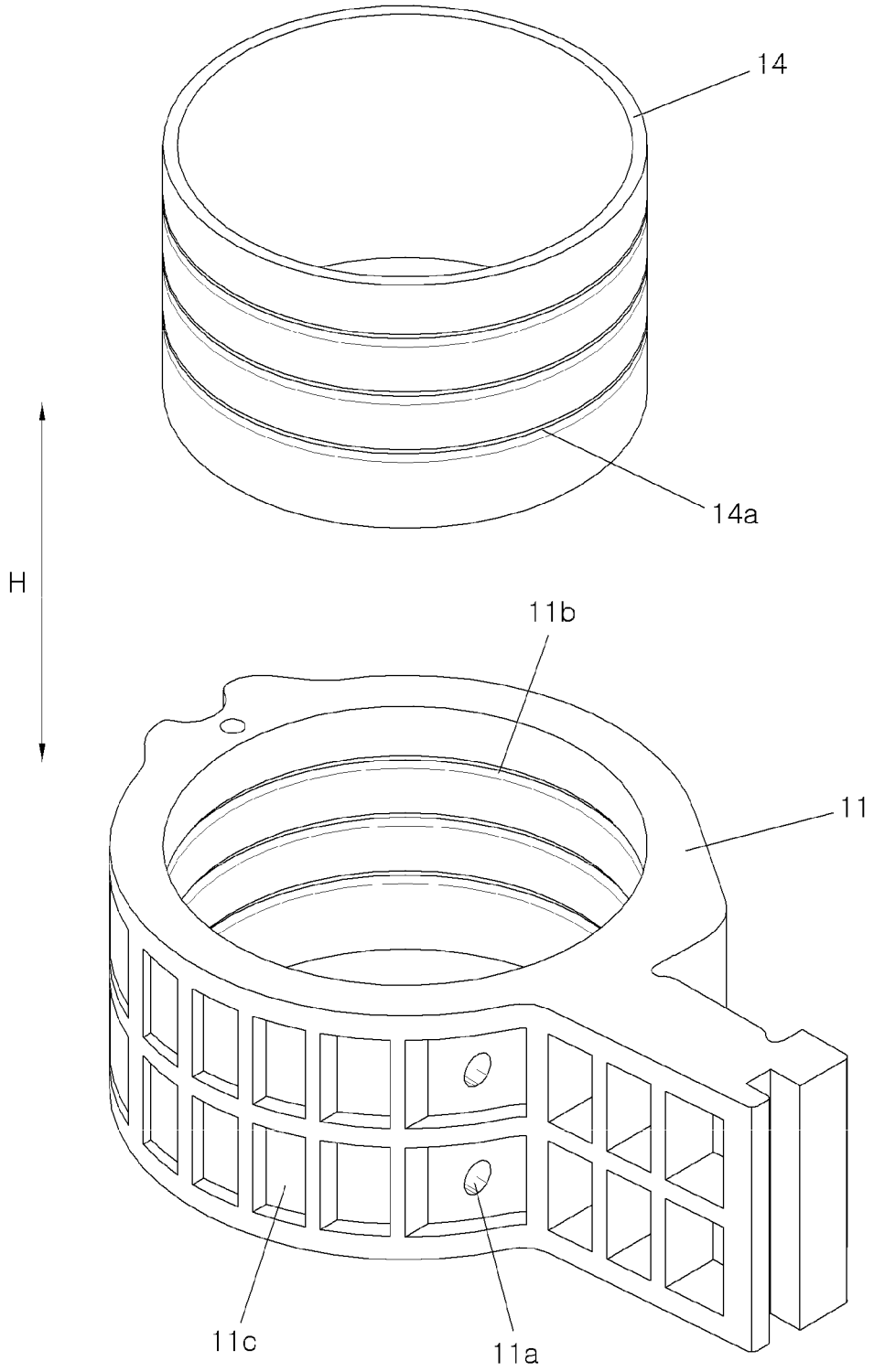
FIG. 3 is an exploded perspective view of a housing and an inner ring in the oil pump according to the exemplary form of the present disclosure.

Particularly, in FIG. 3, at least one first groove 11*b* is formed on the inner surface of the housing 11 along a height direction H and at least one second groove 14*a* is formed on an outer circumference surface of the inner ring 14 along the height direction H. When the oil pump 10 is assembled according to the present disclosure, at least one of the first groove 11*b* in the housing 11 and second groove 14*a* in the inner ring 14 may be formed for receiving oil. Since the oil is provided inside each of the grooves 11*b* and 14*a*, friction between the inner ring 14 and the housing 11 is reduced by the oil while the inner ring 14 rotates in the housing 11.

For example, as shown in FIG. 3, the first groove 11*b* may be formed on the inner surface of the housing 11. The first groove 11*b* may be formed along the circumference direction of the housing 11 at a predetermined depth. In FIG. 3, a plurality of the first grooves 11*b* in the housing 11 may be formed along the height direction H of the housing 11.

On the other hand, the second groove 14*a* may also be formed on the outer circumference surface of the inner ring 14. A plurality of second grooves 14*a* in the inner ring 14 may also be formed along the height direction H of the inner ring 14.

The housing 11 may be provided with at least one oil supply hole 11*a* for supplying oil desired for lubrication between the housing 11 and the inner ring 14. The oil supply holes 11*a* may be formed through the wall of the housing 11 so that oil is supplied from the outside of the housing 11 to the inner surface of the housing 11 for lubricating between the housing 11 and the inner ring 14.

Figure 4:
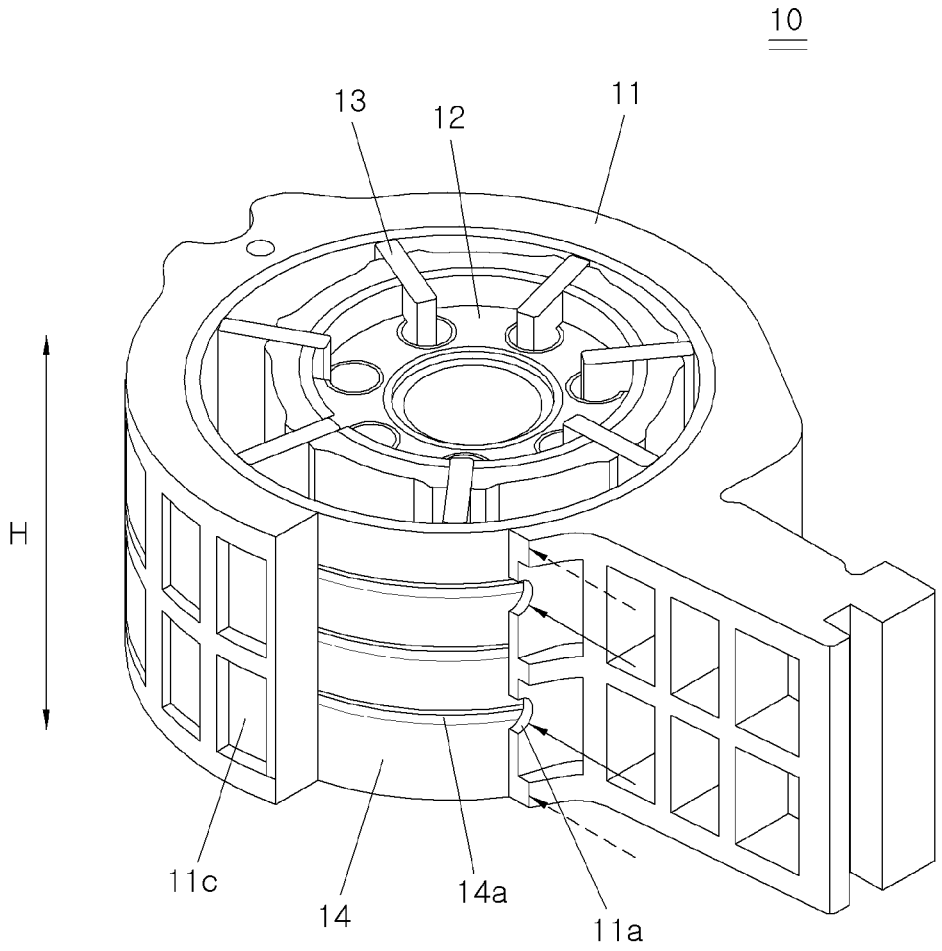
FIG. 4 is a partially cut-away perspective view of the oil pump according to the exemplary form of the present disclosure.

The oil may also be supplied through the surface where the oil pump 10 is assembled. FIG. 4 shows the area where the oil is supplied for the lubrication of the oil pump 10 by arrows. The oil may be supplied through the oil supply hole 11*a* (solid line in FIG. 4) and also be supplied through the surface on which the oil pump 10 is assembled (dotted arrow in FIG. 4).

On the outer surface of the housing 11, at least one pocket 11*c* may be formed concavely from the outer surface of the housing 11 along the circumference direction and the height direction H of the housing 11.

The pockets 11*c* are configured for serving to buffer the pressure wave generated by the oil pressurized by and discharged from the oil pump 10 during operation of the oil pump 10. These pockets 11*c* may be formed in the housing 11 along the circumference direction and the height direction H of the housing 11 for buffering the pressure wave generated when the pressurized oil is discharged from the oil pump 10, thereby improving NVH (Noise, Vibration and Harshness) performance.

Figure 5:
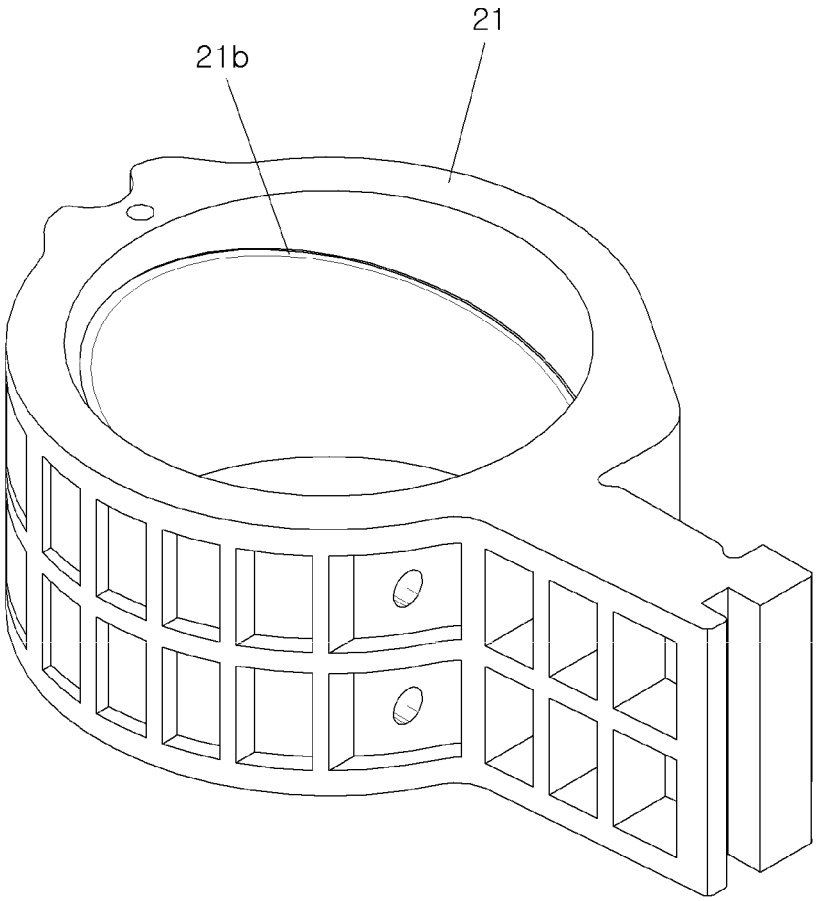
FIG. 5 is a perspective view of a groove with a spiral shape formed in a housing of an oil pump according to another exemplary form of the present disclosure.

FIG. 5 shows an oil pump housing having an inner ring (not shown) according to another exemplary form of the present disclosure.

The present exemplary form has the same configuration as the oil pump described above except that another groove 21*b* of the housing 21 is formed in a different shape. As shown in FIG. 5, the groove 21*b* formed in the housing 21 may be formed in a spiral pattern along the inner surface of the housing 21 to supply oil between the housing 21 and the inner ring (not shown). Furthermore, the groove 21*b* with a spiral shape may also be formed in the inner ring (not shown).

While this present disclosure has been described in connection with what is presently considered to be practical exemplary forms. It is to be understood that the present disclosure is not limited to the disclosed forms, but, on the contrary, it is intended to cover various modification and equivalent arrangements included within the spirit and scope of the present disclosure.

What is claimed is:

1. An oil pump for a vehicle, the oil pump comprising:

a housing forming a space;

a rotor installed to be rotatable in an eccentric position in the housing, the rotor having vanes mounted along a circumferential direction to be protruded and retracted in a radial direction of the housing; and an inner ring fitted to an inner surface of the housing, the inner ring configured to rotate along with the rotor when the rotor rotates, wherein:

a first groove is formed on the inner surface of the housing along the circumferential direction of the housing, a second groove is formed on an outer surface of the inner ring along the circumferential direction, the first groove and the second groove are configured to flow oil between the inner ring and the housing and reduce a friction between the inner ring and the housing, the housing is formed of a material harder than the inner ring, the inner ring is configured to rotate in the same direction as the vanes rotate when the rotor rotates, and the inner ring is configured to rotate along with the vanes when the vanes rotate, and the inner ring is configured to rotate later than the rotor.

2. The oil pump of claim 1, wherein the housing is made of synthetic resin material.

3. The oil pump of claim 2, wherein the housing is made of thermosetting phenolic resin material.

4. The oil pump of claim 1, wherein the housing is made of a light metal having a specific gravity lower than gravity of steel.

5. The oil pump of claim 1, wherein the inner ring is made of the same material as the vanes.

6. The oil pump of claim 1, wherein the housing is provided with at least an oil supply hole for supplying oil between the inner surface of the housing and the inner ring.

7. The oil pump of claim 1, wherein an outer surface of the housing is provided with at least one pocket formed concavely from the outside of the housing to the inner surface of the housing.

8. The oil pump of claim 7, wherein the at least one pocket comprises a plurality of pockets that is formed along the circumferential direction and a height direction of the housing.

9. The oil pump of claim 1, wherein the vanes are slidable in the radial direction and installed at intervals along the circumferential direction.

10. The oil pump of claim 1, wherein the inner ring is formed in a cylinder shape to be fitted to the inner surface of the housing.

11. The oil pump of claim 1, wherein the first groove is formed in a spiral pattern on the inner surface of the housing and configured to supply the oil between the housing and the inner ring.

* * * * *